United States Patent [19]

Stevens

[11] Patent Number: 4,881,442

[45] Date of Patent: Nov. 21, 1989

[54] PLAYING HEIGHT ADJUSTMENT FOR KEYBOARD PERCUSSION INSTRUMENTS

[75] Inventor: Leigh H. Stevens, Asbury Park, N.J.

[73] Assignee: The Selmer Company, Elkhart, Ind.

[21] Appl. No.: 114,482

[22] Filed: Oct. 28, 1987

[51] Int. Cl.[4] ..... G10D 13/08

[52] U.S. Cl. ..... 84/403; 248/422

[58] Field of Search ..... 84/403, 421; 248/422

[56] References Cited

U.S. PATENT DOCUMENTS

| | | | |
|---|---|---|---|
| 674,604 | 5/1901 | Deagan | 84/403 |
| 914,538 | 3/1909 | Watkins | 248/422 |
| 2,540,925 | 2/1951 | Zimmerman | 84/403 |
| 3,443,469 | 5/1969 | Hiraoka | 84/403 X |

*Primary Examiner*—L. T. Hix
*Assistant Examiner*—Brian W. Brown
*Attorney, Agent, or Firm*—Nixon & Vanderhye

[57] ABSTRACT

A support assembly for a marimba or other keyboard percussion instrument that provides quick and easy adjustment of the height of the keyboard to accommodate a player's personal preference or to accommodate different playing heights required by different players.

9 Claims, 4 Drawing Sheets

PLAYING HEIGHT ADJUSTMENT FOR KEYBOARD PERCUSSION INSTRUMENTS

BACKGROUND OF THE INVENTION

1. Field of the Invention

This invention relates to keyboard percussion instruments, such as marimbas, and more particularly to the support assembly for such instruments.

2. Description of the Prior Art

Tuned percussion instruments have been known for many years. The common feature of all tuned percussion instruments is a tuned array of bars, rods, tubes, or the like which, when struck with a mallet, produce musical tones. When properly constructed, adjusted and played, these instruments produce a variety of pleasing musical effects.

Tuned percussion instruments include bells, chimes, glockenspeils, xylophones, vibraphones and marimbas. It is with the last three of these, and particularly marimbas, with which the present invention is concerned.

Traditionally, vibraphones and marimbas have been constructed with a fixed-height frame and support for the bars and resonators. Young students and other shorter players have had to stand on step-type supports in order to position themselves at a comfortable playing height with respect to the bars. Players who are taller than average have had to place the instrument on blocks or other supports in order to raise it to a playing height comfortable to them.

In recent years, some manufacturers have attempted to overcome this problem by providing adjustable height caster wheels or adjustable height frames. The former requires the player to bend over or kneel to adjust each of four caster wheels. The latter, such as the Yamaha Model YV3300 vibraphone, requires the player to lift the weight of one end of the instrument while loosening and re-tightening a clamp screw.

SUMMARY OF THE INVENTION

The present invention overcomes the height adjustment problem by providing a pair of frame plates to support the bar rails and the resonator assemblies, and height adjustment means between the frame plates and the end assemblies of the instrument. In the preferred embodiment, the height adjustment means comprises a jack screw in each end assembly that threadedly engages a screw block fastened to the adjacent frame plate. Each jack screw may easily be rotated by means of a key or crank to quickly and easily adjust the playing height of the instrument.

DETAILED DESCRIPTION OF THE PREFERRED EMBODIMENTS

Figure 1:
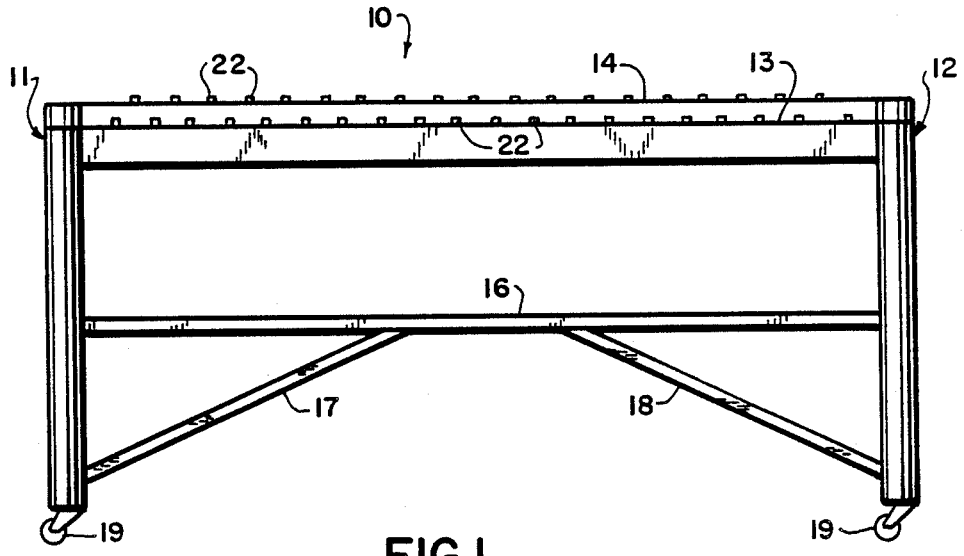
FIG.1 PRIOR ART
FIG. 1 is a rear elevational view of a prior art marimba without bars or resonator assemblies.

Referring now to FIG. 1, there is shown the frame 10 of a marimba having fixed height. The frame 10 comprises a low end assembly 11, a high end assembly 12, and bar support rails 13 and 14. A cross brace 16 and diagonal braces 17 and 18 may also be provided. The end assemblies 11 and 12 are usually supported by caster wheels 19.

Figure 2:
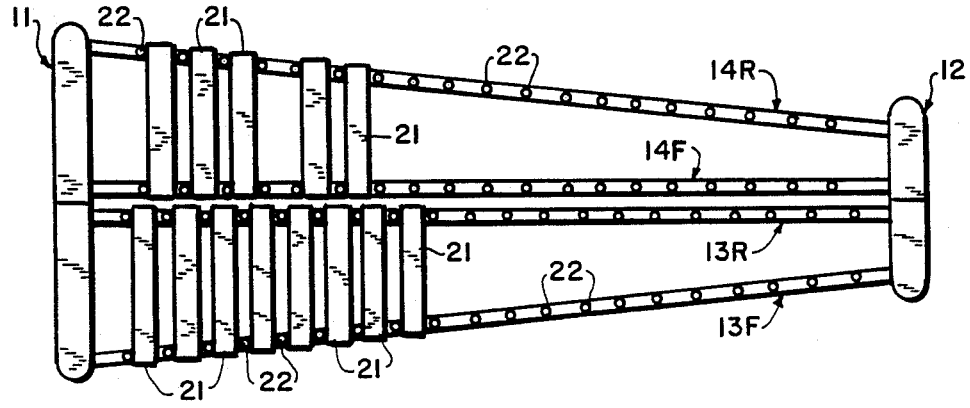
FIG.2 PRIOR ART
FIG. 2 is a top view of the prior art marimba of FIG. 1 showing a plurality of bars in assembled positions.

To those familiar with the instrument, it will immediately be apparent that the tuned bars and resonator assemblies are absent from the illustration of FIG. 1. For illustrative purposes, a plurality of the tuned bars are shown in place in the top view of FIG. 2. These are identified by reference numeral 21. The tuned bars are customarily supported for playing by cords (not shown) that pass through horizontal holes in the tuned bars and rest upon bar supports 22. This form of support is illustrated clearly in U.S. Pat. No. 3,443,469. The bar supports 22 prevent the tuned bars 21 from moving horizontally along the supporting cords without interfering with the vibrations of the bars when they are struck in playing.

It is customary to arrange the tuned bars in substantially the same way as a piano keyboard is arranged. The tuned bars that correspond to the white keys are supported by bar support rails 13F and 13R and the tuned bars that correspond to the black keys are supported by bar support rails 14F and 14R. Frequently the rails 14F and 14R are arranged at a higher level than the rails 13F and 13R so that the bars supported by rails 14 overlap the bars supported by rails 13. This arrangement is more common in the larger professional instruments wherein the longer lower-pitched bars corresponding to the black keys would be difficult to reach for proper playing if they were positioned in the same horizontal plane as the bars corresponding to the white keys.

Figure 3:
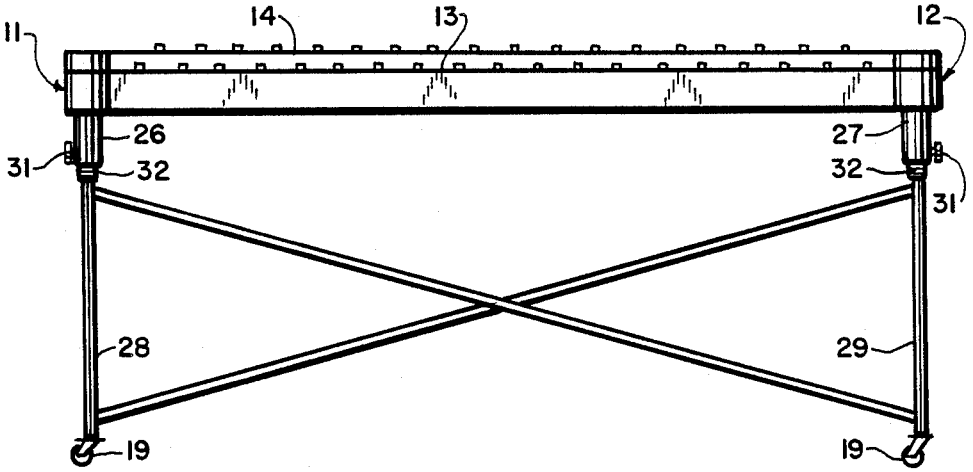
FIG.3 PRIOR ART
FIG. 3 is a rear elevational view of another prior art keyboard percussion instrument having adjustable height legs.

A long-standing problem with keyboard percussion instruments is that they have been traditionally made with a fixed height. Thus, in order to achieve the correct or desired playing height for any particularly player, the player, teacher, or student has been left to his own devices. Younger students and other shorter players have stood on thick telephone directories, choir risers, etc. Taller players have placed the instrument on blocks or some other form of elevating support. One solution for the need for height adjustability has been provided in the manner illustrated in FIG. 3. In FIG. 3, the low end assembly 11 and the high end assembly 12 are provided with tubular support members 26 and 27 which slidingly fit over and receive tubular support members 28 and 29. Wing bolts 31 threaded into members 26 and 27 may be tightened to clamp upon members 28 and 29, respectively, to maintain the instrument at the desired playing height. Preset stops 32 may be set to support members 26 and 27 at some minimal height for ease of assembly.

It will be noted that in order to adjust the height of the instrument illustrated in FIG. 3, it is necessary to lift the total weight supported by one of the end assemblies 11 or 12. This presents no difficulty if the desired height is known at the time the instrument is being assembled, however, if the final desired playing height is unknown at the time of assembly, or if it is necessary or desirable to change the height after the bars and resonator assemblies have been assembled, the weight required to be lifted can be very burdensome. The present invention solves the height adjustment problem by providing a structure wherein the bar support rails and resonator assemblies may be raised or lowered with respect to the end assemblies.

Figure 4:
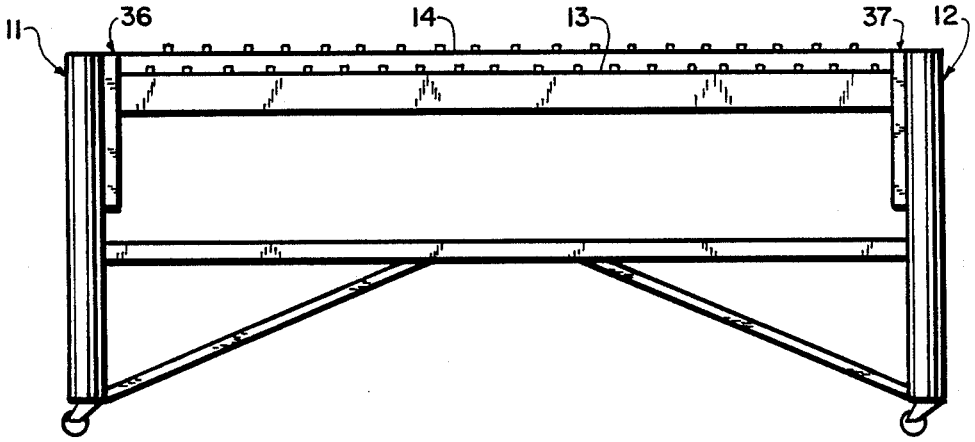
FIG. 4 is a rear elevational view of a marimba embodying the present invention.

Referring now to FIG. 4, there is shown a marimba frame structure having a low end frame plate 36 and a high end frame plate 37. The frame plates 36 and 37 support the bar support rails 13 and 14 and the resonator assemblies which will be described in more detail in connection with FIGS. 5 and 6. Height adjustment means are provided so that frame plate 36 can be raised and lowered with respect to end assembly 11 and frame plate 37 can be raised and lowered with respect to end assembly 12. This adjustment may be accomplished with the instrument fully assembled with the resonator assemblies, bar support rails, and tuned bars all in position for playing.

Figure 5:
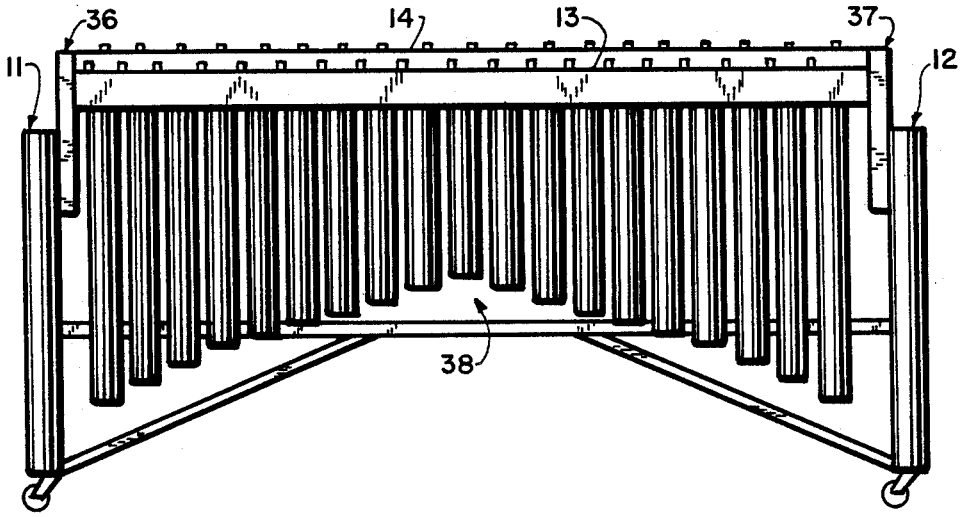
FIG. 5 is an additional rear elevation view of a marimba embodying the present invention showing one resonator assembly in assembled position.
Figure 6:
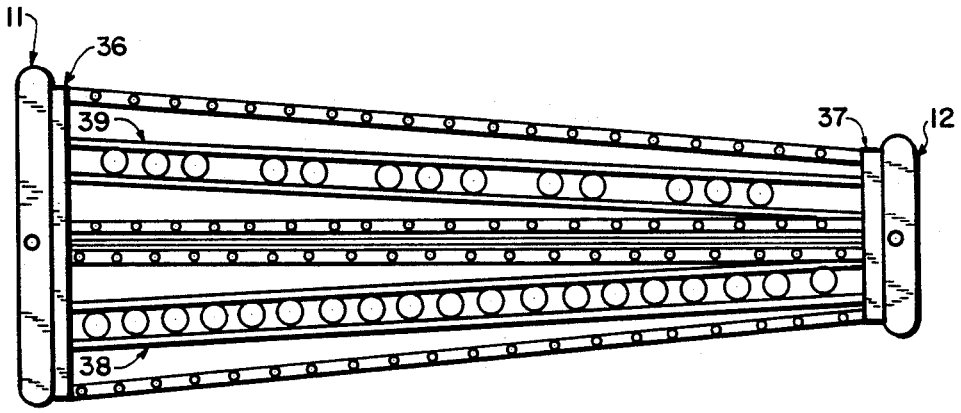
FIG. 6 is a top view of a marimba embodying the present invention showing both resonator assemblies in their assembled positions.

Referring now to FIG. 5 there is shown another illustration of the marimba of FIG. 4 with the playing height of the instrument set at a higher level than that of FIG. 4. It will be seen that the frame plates 36, 37, the bar support rails 13 and 14, and the "white key" resonator assembly indicated generally at 38, are all elevated with respect to end assemblies 11 and 12. For completeness of illustration, a top view of the marimba of FIGS. 4 and 5 is shown in FIG. 6 without the tuned bars. This view clearly shows the location of the white key resonator assembly 38 and the black key resonator assembly 39. It will be appreciated that when the tuned bars, not shown in FIG. 6, are in playing position, each tuned bar has a resonator of one of the resonator assemblies 38, 39 properly positioned beneath it. Because the spacing or separation between the tuned bars and the upper opening of the resonators is critical to proper functioning of the resonators, it is necessary that the resonators be raised and lowered along with the bar support rails and tuned bars.

Figure 7:
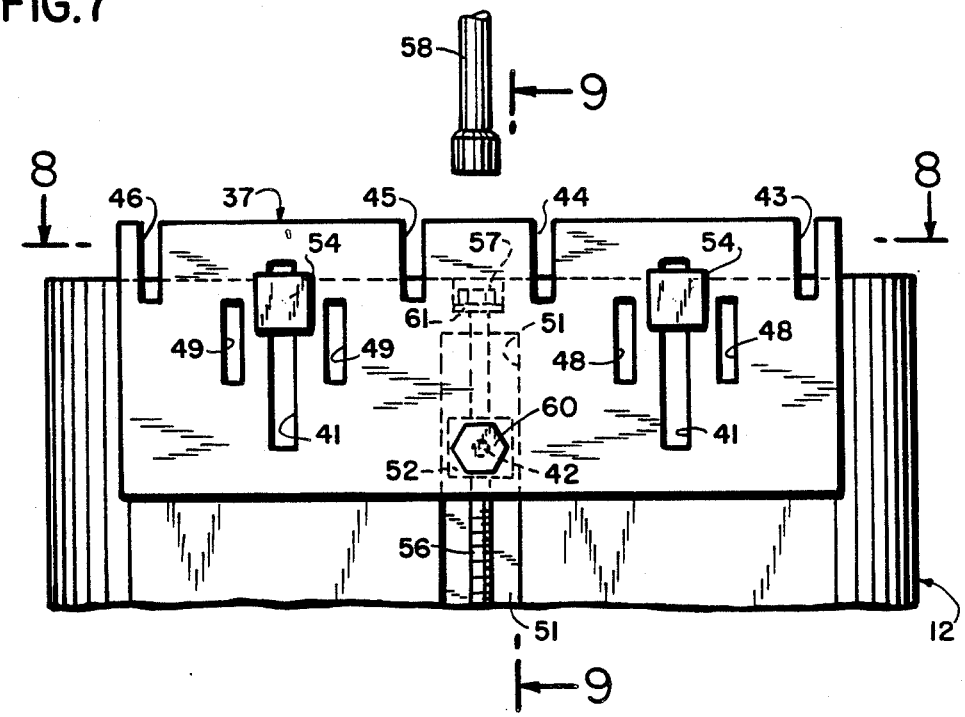
FIG. 7 is an elevation view of the high end frame plate of the marimba of FIG. 6.

FIG. 7 is an enlarged plan view of the high end frame plate 37. Frame plate 37 may be constructed of aluminum plate having a thickness of ¼ inch to ½ inch. There are provided a pair of vertical guide slots 41 and a mounting hole 42. Mounting means are also provided for bar support rails 13F, 13R, 14F, 14R at 43, 44, 45, 46, respectively. Mounting means for resonator assemblies 38 and 39 are provided at 48 and 49, respectively.

Figure 8:
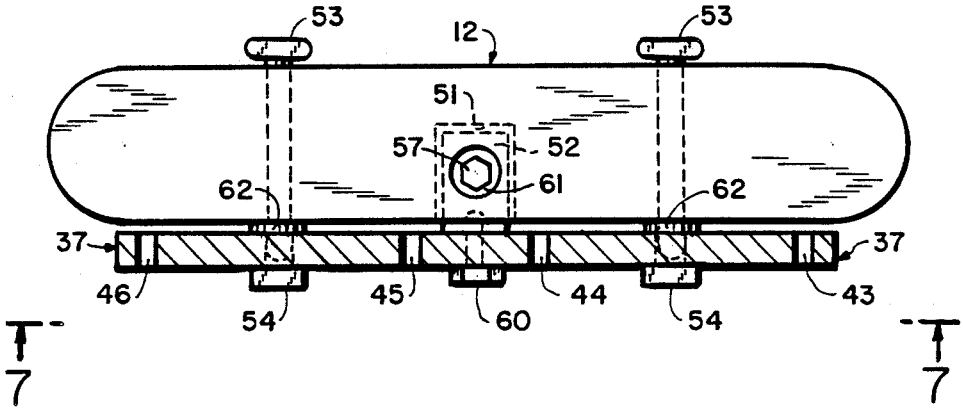
FIG. 8 is a top view of a high end assembly and frame plate of the marimba of FIG. 6 showing the frame plate in section.

FIG. 8 shows a top view of mounting plate 37 and high end assembly 12. Assembly 12 is provided with a vertical channel 51 in which a screw block 52 moves up and down. Screw block 52 is fastened to frame plate 37 by means of a machine screw or bolt 53 which passes through hole 42 and is threaded into a mating hole in screw block 52.

Assembly 12 is provided with a pair of wing bolts 53 which pass through assembly 12 to threadedly engage T-blocks 54 received within the vertical slots 41 of frame plate 37.

Figure 9:
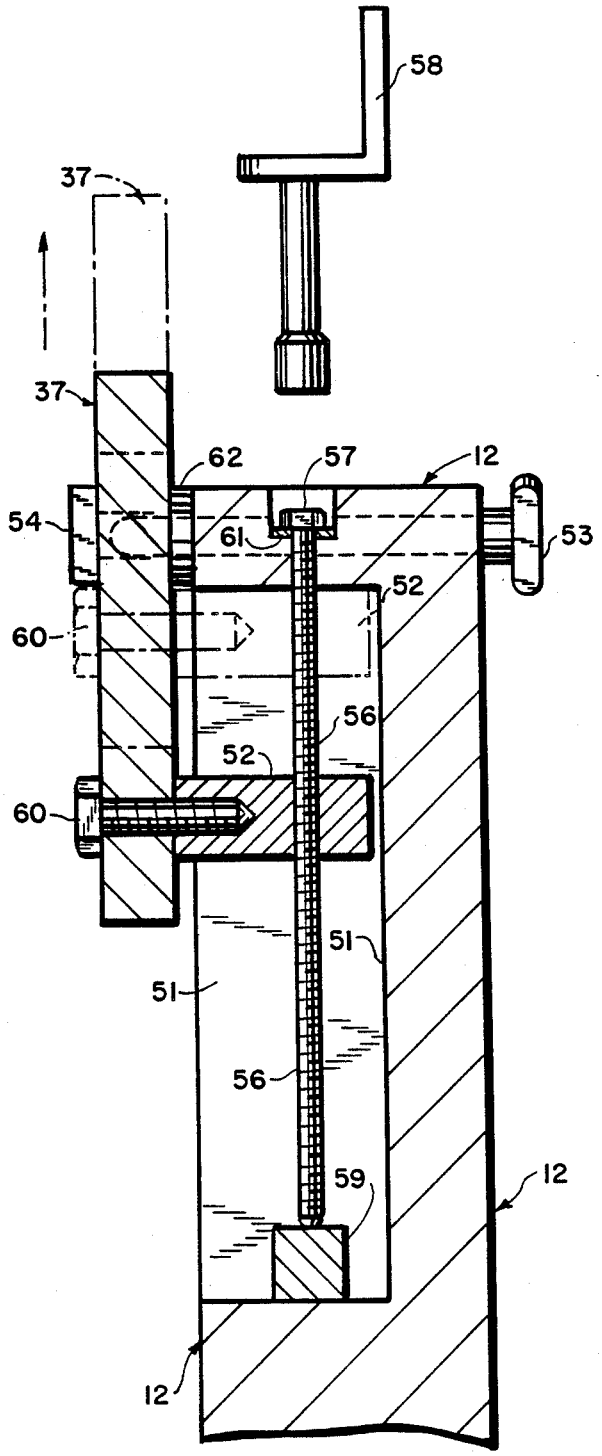
FIG. 9 is a cross-sectional view of the high end assembly and frame plate taken through the plane indicated at 9—9 of FIG. 8.

Referring now to FIG. 9, it will be seen that assembly 12 also includes a vertical jack screw 56 having a square, hex or other head 57 for receiving a key or crank 58. Jack screw 56 is threaded through screw block 52 and thereby supports at end assembly 12 the weight of the frame plates, bar support rails, and resonator assemblies. This weight is transferred to end assembly 12 by means of a bearing block 59 that supports the bottom end of jack screw 56 or alternatively by a flange 61 on jack screw 56 located adjacent head 57. T-blocks 54 extend less than all the way through frame plate 37 (and similarly, frame plate 36) so that when wing bolts 53 are tightened, frame plate 37 is drawn against the inner surface of end assembly 12. Alternatively, a spacer washer 62 may be placed on each wing bolt 53 to provide frictional contact between the frame plates and end assemblies. Thus, with or without the spacers 62, when wing bolt 53 is tightened into its mating T-block 54, which is provided with a tapped hole for threadedly receiving wing bolt 53, the frame plates 36, 37 may be firmly secured to the end assemblies 11, 12, respectively, without relying on jack screws 56.

In one embodiment of the present invention actually manufactured and assembled, jack screw 56 has been provided with a thread having a lead of 1/16 inch per revolution. This pitch is fine enough to provide for a very small torque to be applied by key or crank 58 even when positioning the fully assembled instrument, and also provides a substantially self-locking feature where, at least for short periods of time, the positioning holds without the necessity of tightening wing bolts 53. It is anticipated that perhaps a coarser pitch can still provide a desirably low torque and not require so many turns to adjust the instrument playing position. The coarser pitch, however, may not be self-locking and if that is the case, would require the use of additional locking or clamping means such as the wing bolts 53 and T-blocks 54.

Having read the foregoing specification with reference to the drawing and the numerous parts illustrated therein, a person skilled in the art of designing or manufacturing keyboard percussion musical instruments will readily understand the structure and operation of the present invention. The foregoing description, however, while setting forth the best mode contemplated by the inventor for making and practicing the present invention, should be considered as illustrative and not restrictive in nature. It is intended that modifications and variations of the above-described invention that fall within the spirit thereof shall be covered by the following claims.

What is claimed is:

1. In a musical percussion instrument having a pair of spaced end supports, a generally horizontal array of tuned elements for producing musical tones between said end supports, and support rails for supporting said array of tuned elements, the improvement comprising:

a pair of intermediate supports secured to opposing ends of said support rails, each intermediate support being mounted on a respective end support for allowing vertical translation of said intermediate supports with respect to said end supports;

a pair of jack screws each rotatably mounted and supported on a respective end support;

coupling means for coupling each jack screw to a respective intermediate support for raising said intermediate support when said jack screw is rotated in one direction and for lowering said intermediate support when said jack screw is rotated in an opposite direction, said coupling means including a screw block secured to each intermediate support, said screw block having a tapped hole for threadedly receiving said jack screw;

said end support including a bearing block for supporting said jack screw;

whereby height adjustment of said bar support rails and said tuned elements in a vertical plane relative to said end supports is accomplished by selective rotation of said jack screws.

2. In a musical percussion instrument having a pair of spaced end supports, a generally horizontal array of tuned elements for producing musical tones between said end supports, and support rails for supporting said array of tuned elements, the improvement comprising:

a pair of intermediate supports secured to opposing ends of said support rails, each intermediate support being mounted on a respective end support for allowing vertical translation of said intermediate supports with respect to said end supports;

a pair of jack screws each rotatably mounted and supported on a respective end support;

coupling means for coupling each jack screw to a respective intermediate support for raising said intermediate support when said jack screw is rotated in one direction and for lowering said intermediate support when said jack screw is rotated in an opposite direction, said coupling means including a screw block secured to each intermediate support, said screw block having a tapped hole for threadedly receiving said jack screw;

said end support having a wall portion through which said jack screw extends, and said jack screw has a flange cooperating with said wall portion for supporting said jack screw; and whereby height adjustment of said bar support rails and said tuned elements in a vertical plane relative to said end supports is accomplished by selective rotation of said jack screws.

3. In a musical percussion instrument having a pair of spaced end supports, a generally horizontal array of tuned elements for producing musical tones between said end supports, and support rails for supporting said array of tuned elements, the improvement comprising:

a pair of intermediate supports secured to opposing ends of said support rails, each intermediate support being mounted on a respective end support for allowing vertical translation of said intermediate supports with respect to said end supports;

a pair of jack screws each rotatably mounted and supported on a respective end support;

coupling means for coupling each jack screw to a respective intermediate support for raising said intermediate support when said jack screw is rotated in one direction and for lowering said intermediate support when said jack screw is rotated in an opposite direction, said coupling means including a screw block secured to each intermediate support, said screw block having a tapped hole for threadedly receiving said jack screw;

said end support having a wall portion through which said jack screw extends, and said jack screw has a flange cooperating with said wall portion for supporting said jack screw;

whereby height adjustment of said bar support rails and said tuned elements in a vertical plane relative to said end supports is accomplished by selective rotation of said jack screws; and resonator assemblies supported by said intermediate supports in proper relationship to said tuned bars.

4. A musical instrument as claimed in claim 3, wherein a said end support further comprises a bearing block for supporting a said jack screw.

5. In a musical percussion instrument having a pair of spaced end supports, a generally horizontal array of tuned elements for producing musical tones between said end supports, and support rails for supporting said array of tuned elements, the improvement comprising:

a pair of intermediate supports secured to opposing ends of said support rails, each intermediate support being mounted on a respective end support for allowing vertical translation of said intermediate supports with respect to said end supports;

a pair of jack screws each rotatably mounted and supported on a respective end support;

coupling means for coupling each jack screw to a respective intermediate support for raising said intermediate support when said jack screw is rotated in one direction and for lowering said intermediate support when said jack screw is rotated in an opposite direction, said end support including a bearing block for supporting a said jack screw, and a wall portion through which said jack screw extends, said jack screw having a flange cooperating with said wall portion for supporting said jack screw;

whereby height adjustment of said bar support rails and said tuned elements in a vertical plane relative to said end supports is accomplished by selective rotation of said jack screws; and resonator assemblies supported by said intermediate supports in proper relationship to tuned bars.

6. In a musical percussion instrument having a pair of spaced end supports, a generally horizontal array of tuned elements for producing musical tones between said end supports, and support rails for supporting said array of tuned elements, the improvement comprising:

a pair of intermediate supports secured to opposing ends of said support rails, each intermediate support being mounted on a respective end support for allowing vertical translation of said intermediate supports with respect to said end supports;

a pair of vertically disposed jack screws each rotatably mounted and supported on a respective end support;

coupling means for coupling each jack screw to a respective intermediate support for raising said intermediate support when said jack screw is rotated in one direction and for lowering said intermediate support when said jack screw is rotated in an opposite direction, and a screw block secured to each intermediate support, said screw block having a tapped hole for threadedly receiving said jack screw;

each said end support including a bearing block for supporting said jack screw, said bearing block underlying the lower end of said jack screw and being engaged thereby;

guide means for guiding said intermediate support as it is adjusted up and down with respect to at least one of said end supports;

said height adjustment of said bar support rails and said tuned elements in a vertical plane relative to said end supports being accomplished by selective rotation of said jack screws whereby said jack screws remain vertically stationary relative to the end supports and said bearing blocks as said intermediate supports are displaced vertically relative to the end supports by selective rotation of said jack screws.

7. A musical instrument as claimed in claim 6, wherein said instrument further comprises resonator assemblies supported by said intermediate supports in proper relationship to said tuned bars.

8. The invention according to claim 6 further comprising clamp means for clamping at least one of said intermediate support in a selected position with respect to at least one of said end supports.

9. A musical instrument as claimed in claim 6, wherein a said end support has a wall portion through which said jack screw extends, and said jack screw has a flange cooperating with said wall portion for supporting said jack screw.

* * * * *